US010352032B2

(12) United States Patent
Dian

(10) Patent No.: US 10,352,032 B2
(45) Date of Patent: Jul. 16, 2019

(54) TRENCH DRAIN BRIDGE AND CLIP ATTACHMENT FOR THE SAME

(71) Applicant: Zurn Industries, LLC, Milwaukee, WI (US)

(72) Inventor: Ludovit Dian, Mississauga (CA)

(73) Assignee: Zurn Industries, LLC, Milwaukee, WI (US)

( * ) Notice: Subject to any disclaimer, the term of this patent is extended or adjusted under 35 U.S.C. 154(b) by 0 days.

(21) Appl. No.: 15/878,949

(22) Filed: Jan. 24, 2018

(65) Prior Publication Data

US 2018/0209132 A1 Jul. 26, 2018

Related U.S. Application Data

(60) Provisional application No. 62/450,901, filed on Jan. 26, 2017.

(51) Int. Cl.

| | |
|---|---|
| ***E03F 5/06*** | (2006.01) |
| ***E01C 11/22*** | (2006.01) |
| ***E02B 11/00*** | (2006.01) |
| ***E03F 3/04*** | (2006.01) |
| ***E03F 5/04*** | (2006.01) |

(52) U.S. Cl.

CPC ..... *E03F 5/06* (2013.01); *E01C 11/227* (2013.01); *E02B 11/005* (2013.01); *E03F 3/046* (2013.01); *E03F 5/0401* (2013.01); *E03F 2005/065* (2013.01)

(58) Field of Classification Search

CPC ..... E03F 3/046; E03F 5/0401; E03F 5/0407; E03F 5/0408; E03F 5/06; E03F 2005/065; E03C 1/26; E01C 11/227

USPC ..... 210/163, 164; 404/2, 4, 5; 4/292, 679

See application file for complete search history.

(56) References Cited

U.S. PATENT DOCUMENTS

| | | | | |
|---|---|---|---|---|
| 3,225,545 | A | 12/1965 | Flegel | |
| 4,472,078 | A | 9/1984 | Karbstein | |
| 4,630,962 | A * | 12/1986 | Thomann | E01C 11/227 210/163 |
| 4,699,544 | A | 10/1987 | Karbstein | |
| 5,066,165 | A | 11/1991 | Wofford et al. | |
| 5,281,051 | A | 1/1994 | Stegall | |
| 5,437,516 | A * | 8/1995 | Sauerwein | E03F 5/06 404/2 |
| 5,564,860 | A * | 10/1996 | Amann | E03F 5/06 404/2 |
| 5,653,553 | A * | 8/1997 | Gunter | E03F 3/046 404/4 |
| 5,718,537 | A * | 2/1998 | Becker | E01C 11/227 404/2 |
| 6,595,720 | B2 | 7/2003 | Humphries et al. | |
| 6,945,733 | B2 * | 9/2005 | Rathmann | E03F 5/06 210/163 |
| 7,252,457 | B2 | 8/2007 | Humphries et al. | |
| 7,413,372 | B2 | 8/2008 | Meyers | |
| 8,474,068 | B2 | 7/2013 | Kik, Sr. et al. | |
| 2003/0147693 | A1 | 8/2003 | Knak et al. | |
| 2005/0055887 | A1 | 3/2005 | Benesteau et al. | |

(Continued)

*Primary Examiner* — Christopher Upton

(74) *Attorney, Agent, or Firm* — Quarles & Brady LLP

(57) ABSTRACT

A trench drain assembly includes a cross-bar that can swivel into arcuate guides in the sidewalls of the trench drain assembly and a grate clip assembly for reversibly attaching a grate to a cross-bar, whether of the swivel in type described herein or a cross-bar of a different style.

16 Claims, 6 Drawing Sheets

(56) References Cited

U.S. PATENT DOCUMENTS

| | | | |
|---|---|---|---|
| 2011/0162137 | A1 | 7/2011 | Kik, Sr. et al. |
| 2014/0110007 | A1 | 4/2014 | Humphries et al. |
| 2016/0319530 | A1 | 11/2016 | Files, Jr. |

* cited by examiner

TRENCH DRAIN BRIDGE AND CLIP ATTACHMENT FOR THE SAME

CROSS-REFERENCE TO RELATED APPLICATION

This application claims the benefit of U.S. Provisional Patent Application No. 62/450,901 filed on Jan. 26, 2017, which is incorporated by reference herein in its entirety for all purposes.

STATEMENT OF FEDERALLY SPONSORED RESEARCH OR DEVELOPMENT

Not applicable.

TECHNICAL FIELD

This application relates to trench drains used to transport liquid to a drainage sewer. More specifically, this application relates to an improved trench drain cross-bar that can be more easily installed to support the walls of the trench, as well as a clip attachment for reversibly securing a grate onto a cross-bar.

BACKGROUND

Trench drains are used where extensive amounts of liquid must be moved from one place to another. Trench drains generally transport the liquid to a drainage sewer or some other drainage reservoir. Typically, trench drains are U-shaped or V-shaped troughs and are installed adjacent to either roadways or buildings.

Trench drain systems include several basic designs: concrete, metal and plastic. Generally, concrete trench drain systems use forms. The forms are placed in a ditch dug in the ground. Concrete is then poured around the forms, which are removed after the concrete has set. Trench drain systems made in accordance with this method or similar methods result in relatively expensive systems due to the cost of installing and removing the forms.

Many of the expenses associated with these prior art trench drain systems have been overcome by the advent of polymeric trench drains, which can be left in place after the concrete has been poured in place. These trench drains perform two functions. First, they act as a form for the concrete; and second, they act as a liner. The manufacture and transportation costs with this type of trench drain are significantly less than the other types of trench drains.

Polymeric materials are somewhat flexible and may bow in during their casting into concrete. To this end, internal supports might be employed to secure the walls in place. However, assembly of such supports into the trench drain can pose a fabrication and/or assembly problem.

Further still, once cast in place, the trench drain is typically covered by a grate. In many instances, the grate may simply rest in the upper opening, but it may be preferable that the grate be secured in place. However, such securing can often require significant labor on-site after installation to put the grate in place. In many instances, with the trench drain already in place, it can be difficult for an installer to use tools at or below ground level to secure the grate in place.

SUMMARY

Various improvements to trench drains are described herein including improvements relating to reinforcement cross-bars and fixation mechanisms for attaching the grate to the reinforcement cross-bars. It will be appreciated that the various improvements could potentially be used separate from one another or in various combinations and permutations with one another.

According to one aspect, a trench drain assembly is provided that comprises a pair of trench sidewalls, a cross-bar, a grate, and a grate clip assembly. The cross-bar extends between the pair of trench sidewalls. The grate spans between the pair of trench sidewalls and extends along an axial direction of the trench drain assembly. The grate clip assembly includes a grate clip and a fastener. The grate clip has a pair of deformable catch arms connected by a bridging section. The fastener is coupled to the grate clip and secures the grate to the grate clip. The pair of deformable catch arms are configured to reversibly engage the cross-bar.

In some forms, the grate can be secured between the fastener and the grate clip and, more specifically, the grate can be secured or compressed between the fastener and an upper surface of the bridging section of the grate clip. In other forms, the grate clip can further include upper engagement surfaces disposed upwardly from the bridging section of the grate clip. In these instances, when the grate is secured to the grate clip, the grate may be secured or compressed between the fastener and the upper engagement surfaces of the grate clip.

In some forms, each trench sidewall of the pair of trench sidewalls can include an arcuate guide disposed proximate an upper end of the corresponding trench sidewall. The cross-bar can include a pair of tabs extending from opposite ends of the cross-bar. Each tab of the pair of tabs can be configured to engage one of the arcuate guides of the pair of trench sidewalls. Further still, in some specific forms, each tab of the pair of tabs can include an extension extending parallel to an edge of the corresponding end of the cross-bar. The arcuate guides of the pair of trench sidewalls may extend through an upper surface of the corresponding trench sidewall into the sidewall. In this way, the arcuate guides may allow for the pair of tabs of the cross-bar to be inserted into corresponding arcuate guides and swiveled into engagement with the corresponding arcuate guides.

In accordance with another aspect, a trench drain assembly is provided that comprises a pair of trench sidewalls and a cross-bar. Each of the pair of trench sidewalls includes an arcuate guide disposed proximate an upper edge of the corresponding trench sidewall. The cross-bar extends between the pair of trench sidewalls and includes a pair of tabs extending from opposite ends of the cross-bar. Each of the pair of tabs is configured to engage one of the arcuate guides of the pair of trench sidewalls.

In some instances, the arcuate guides of the pair of trench sidewalls can extend through an upper surface of the corresponding trench sidewall. In these instances, the arcuate guides can allow for the pair of tabs of the cross-bar to be inserted into corresponding arcuate guides and swiveled into engagement with the corresponding arcuate guides. Additionally, the cross-bar can include a pair of cross-bar sidewalls connected by a bridging surface. The pair of tabs can extend from the bridging surface.

In some forms and as noted in the first aspect, the assembly may further include a grate and a grate clip assembly. The grate may span between the pair of trench sidewalls and extending along an axial direction of the trench drain assembly. The grate clip assembly can include a grate clip and a fastener in which the grate clip has a pair of deformable catch arms connected by a bridging section and in which the fastener is coupled to the grate clip and secures the grate to the grate clip. The pair of deformable catch arms may be configured to reversibly engage the cross-bar. Again, it is contemplated that, in some forms, the grate may be secured or compressed between the fastener and either an upper surface of the bridging section of the grate clip or upper engagement surfaces disposed upwardly from the bridging section of the grate clip.

These and still other advantages of the invention will be apparent from the detailed description and drawings. What follows is merely a description of some preferred embodiments of the present invention. To assess the full scope of the invention, the claims should be looked to as these preferred embodiments are not intended to be the only embodiments within the scope of the claims.

DETAILED DESCRIPTION

Figure 1:
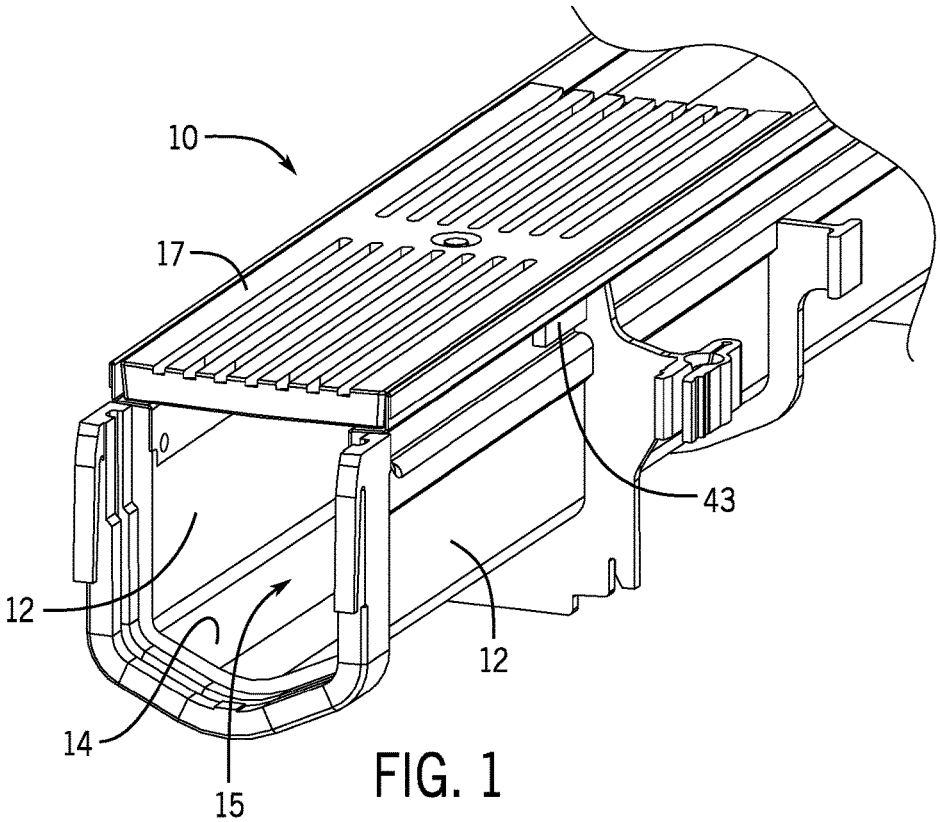
FIG. 1 is a top perspective view of a trench drain incorporating a swivel-type cross-bar and grate clip assembly for attachment of the grate to the cross-bar.
Figure 2:
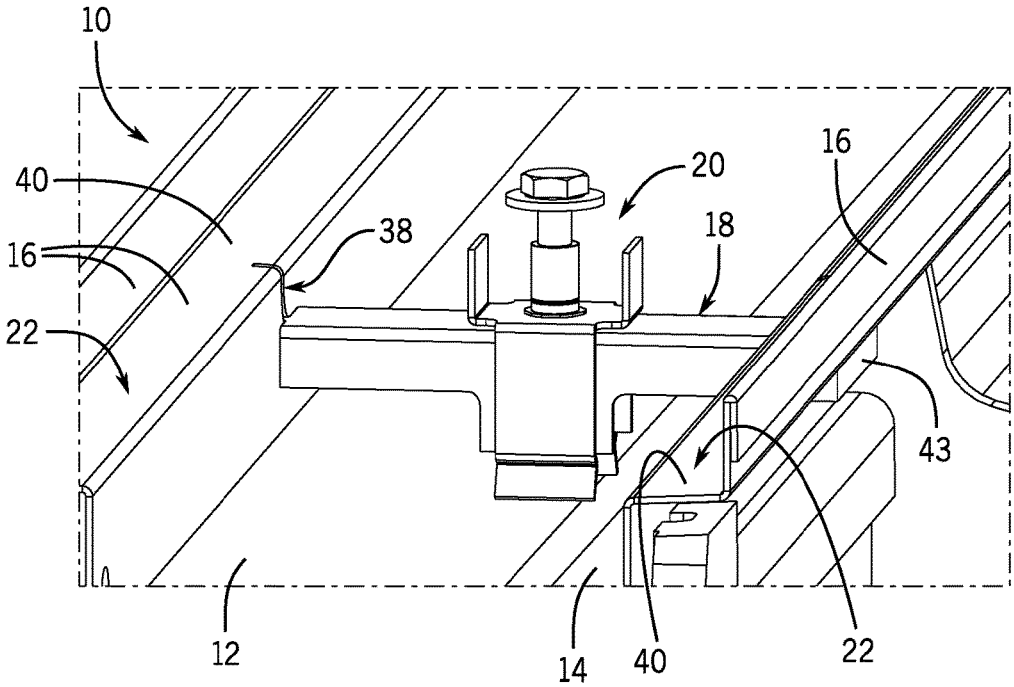
FIG. 2 is a detail view of the trench drain shown in FIG. 1 with the grate hidden, showing the grate clip assembly attached to the cross-bar.

FIGS. 1 and 2 show a U-shaped trench drain assembly 10. In some forms the trench drain is made of a polymeric or plastic material, such as a resin containing fiberglass, nylon, or a polyethylene and formed in individual lengths of approximately eighty inches.

The trench drain assembly 10 includes a polymeric trench drain including a pair of spaced apart trench sidewalls 12 connected to a U-shaped bottom wall 14 and define an open-faced channel 15. The trench sidewalls 12 can either be straight or angled. Likewise, the bottom wall 14 can either be flat, round, or angled so that water or other liquids can be directed from one end to another. In any event, the particular geometry of the trench drain and channel can deviate from that illustrated.

In some instances, the trench drain can have axially-extending metal rails 16 disposed along upper edges of each trench sidewall 12 for reinforcing the sidewalls 12 and for receiving a grate 17. However, it is also contemplated that an entire polymeric trench drain (such as is subsequently depicted in the alternative design of FIG. 6) or trench drain made of different materials could be used to form the structures formed herein.

Figure 9:
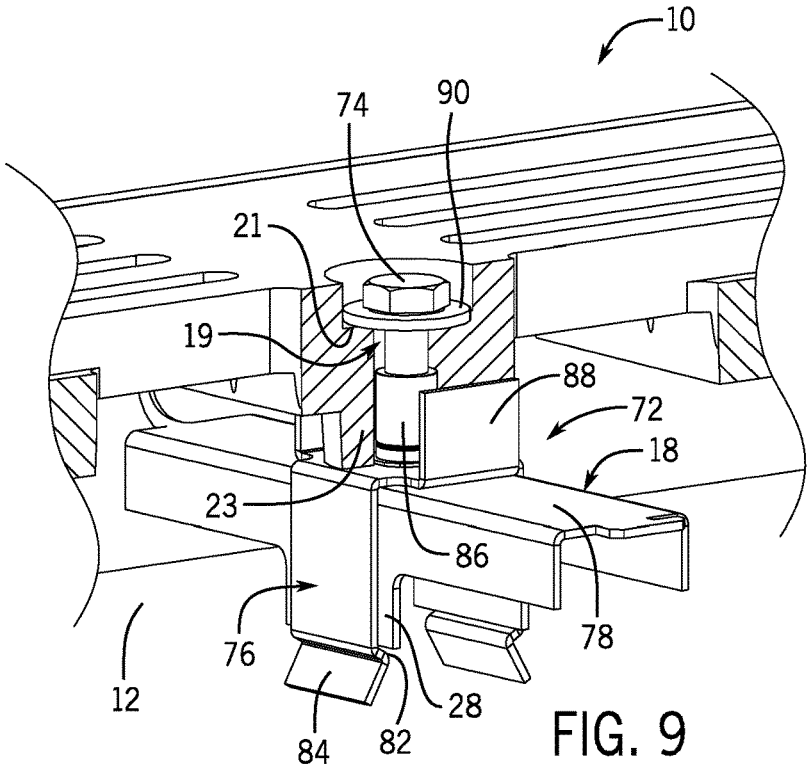
FIG. 9 is a partial cross-sectional view of the cross-bar and grate clip assembly installed onto the trench drain of FIG. 1.

The trench drain assembly 10 further includes a grate 17 (shown in FIG. 1 supported by the rails 16 which are themselves shown best in FIG. 2 with the grate 17 hidden), a cross-bar 18 (shown in FIG. 2), and a grate clip assembly 20 (also shown in FIG. 2). The grate 17 spans between the pair of trench sidewalls 12 and extends along an axial direction of the trench drain to cover the inner channel of the trench drain. In the illustrated design, the grate 17 is received between lips 22 formed by the axially-extending metal rails 16 and is further secured to the grate clip assembly 20, which will be discussed in detail below. As best illustrated in FIG. 9, the grate 17 includes a grate aperture 19, which is surrounded by a grate aperture recess 21. Opposite the grate aperture recess 21, the grate 17 further includes a grate aperture protrusion 23.

Figure 3:
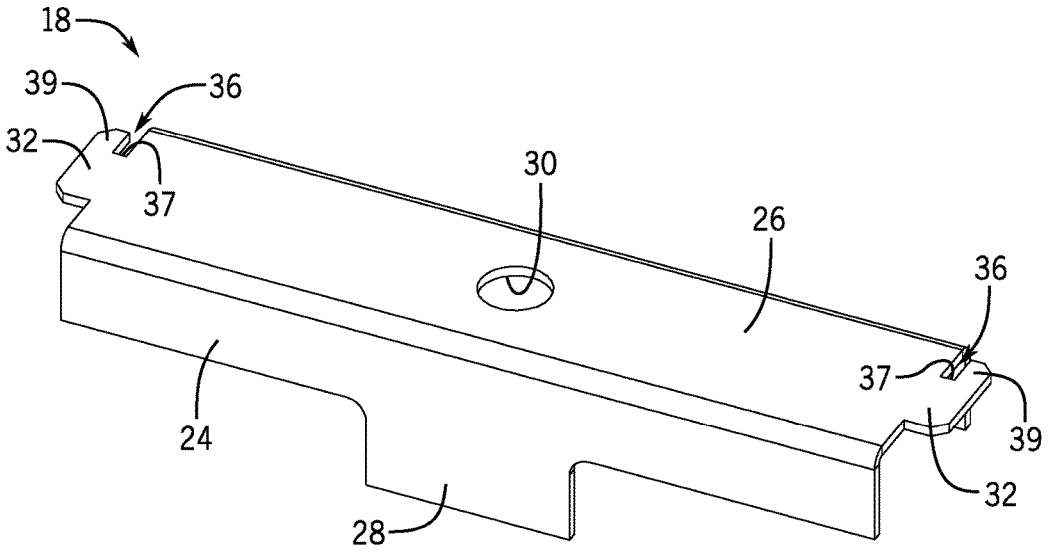
FIG. 3 is a top perspective view of a cross-bar of the trench drain assembly of FIG. 1 apart from the rest of the assembly.
Figure 4:
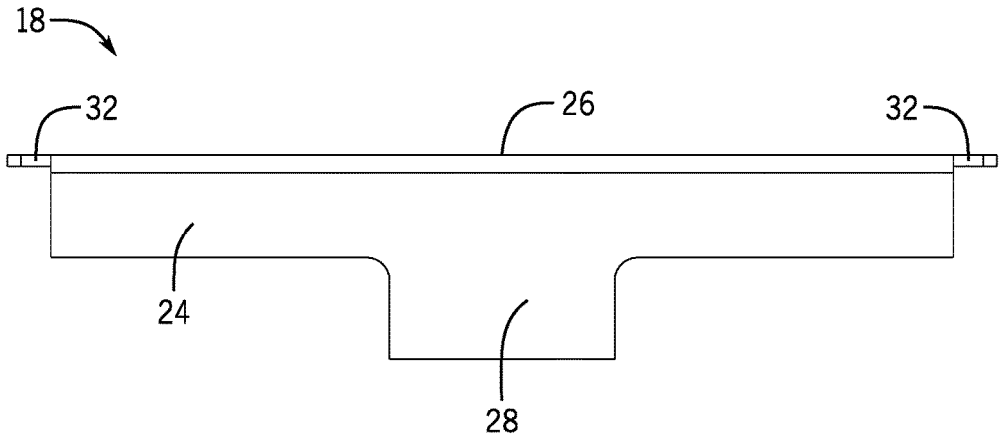
FIG. 4 is a front elevational view of the cross-bar of FIG. 3.

Referring now to FIGS. 3 and 4, the cross-bar 18 is illustrated separate from the rest of the assembly 10. The cross-bar 18 includes a pair of cross-bar sidewalls 24 connected by a bridging section 26. The pair of cross-bar sidewalls 24 extend substantially perpendicularly from opposing edges of the bridging section 26, such that the cross-bar 18 defines a U-shaped feature. Each cross-bar sidewall 24 additionally includes a sidewall extension 28 disposed centrally on the corresponding cross-bar sidewall 24. The sidewall extensions 28 extend from an edge of the corresponding cross-bar sidewall 24 opposite the bridging section 26 further downwardly away from the bridging section 26. These sidewall extensions 28 may be selected to have a length corresponding to the engaging legs of the grate clip assembly 20.

The bridging section 26 of the cross-bar 18 also includes an attachment aperture 30 and a pair of tabs 32. The attachment aperture 30 is disposed centrally on the bridging section 26 and can be configured to engage the grate clip assembly 20 or the grate 17 directly. The pair of tabs 32 extend from opposite ends of the bridging section 26, generally laterally away from the bridging section 26, in a direction that is coplanar to a plane defined by the bridging section 26. Each of the pair of tabs 32 additionally includes an engagement notch 36 disposed adjacent the bridging section 26, which forms a corresponding engagement portion 39. Each of the engagement notches 36 face the same axial side of the cross-bar 18 (axial being defined with respect to the trench drain in which the cross-bar 18 is ultimately assembly).

Figure 5:
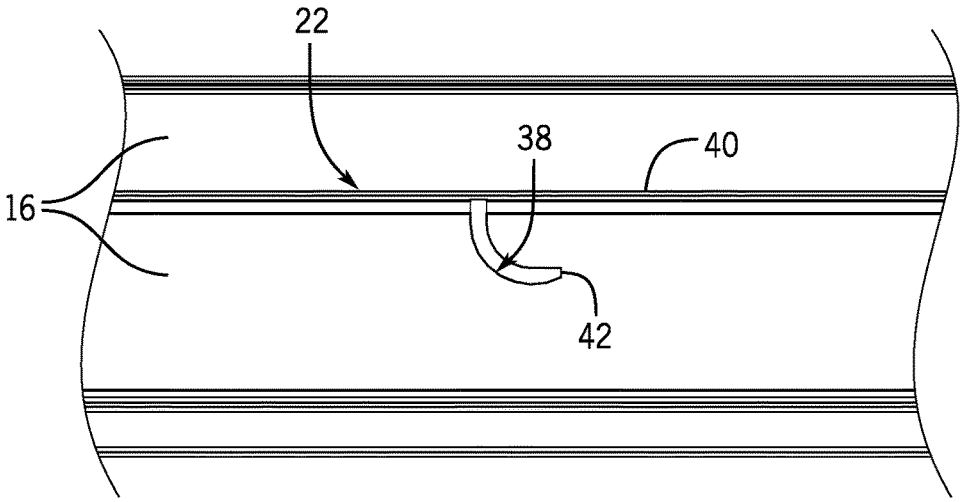
FIG. 5 is a detailed side view of an arcuate guide on a trench sidewall of the trench drain of FIG. 1 without the cross-bar or grate installed.

Referring now to FIGS. 2 and 5, the pair of tabs 32 of the cross-bar 18 are configured to engage arcuate guides 38 of the trench sidewalls 12. As illustrated in FIG. 5, each of the arcuate guides 38 are formed in the axially-extending metal rail 16 of the corresponding trench sidewall 12; however, in rail designs, the guides may be formed directly in the trench drain instead of the rail as described in this paragraph. Each arcuate guide 38 extends through a horizontal surface 40 of the corresponding lip 22, downward into the axially-extending metal rail 16, and curves approximately ninety degrees to a guide end 42 that is substantially horizontal within the axially-extending metal rail 16.

Additionally, the axially-extending metal rail 16 further includes a guide cover 43 (shown in FIGS. 1 and 2) disposed adjacent an outer surface of the axially-extending metal rail 16, which envelopes the arcuate guide 38 on the outer surface. The guide cover 43 is configured to prevent cement from flowing into the inner channel of the trench drain, through the arcuate guide 38, during installation, and is also configured to prevent water from flowing out of the inner channel of the trench drain, through the arcuate guide 38, during use.

Now that the structure of the cross-bar 18 and the trench drain have been discussed above, one exemplary method of installing the cross-bar 18 between the trench sidewalls 12 of the trench drain will be described below. It will be understood that the method described below is provided as an example and is in no way meant to be limiting. It will be appreciated that other trench drain and cross-bar designs may have different features which may engage one another in different ways than those specifically described below.

To install the cross-bar 18 between the trench sidewalls 12 of the trench drain, a user can first insert the pair of tabs 32 of the cross-bar 18 into the corresponding arcuate guides 38, with the pair of tabs 32 first entering the arcuate guides 38 at the horizontal surfaces 40 of the lips 22 of the trench sidewalls 12. In the particular design illustrated, the pair of tabs 32 should be inserted into the arcuate guides 38 with the engagement notches 36 of the pair of tabs 32 facing the horizontal surfaces 40 of the trench sidewalls 12 upon insertion.

The cross-bar 18 can then be swiveled downward, along an arcuate path, such that the pair of tabs 32 slide within the arcuate guides 38. Eventually, as the cross-bar 18 is swiveled downward, an inner surface 37 (shown in FIG. 3) of each engagement notch 36 contacts the guide end 42 of each arcuate guide 38. As such, when inserting the pair of tabs 32 into the arcuate guides 38, an upper surface of the bridging section 26 will be facing the direction that the arcuate guides 38 curve, such that the upper surface ends up facing upwards after the cross-bar 18 has been fully swiveled into place. It should also be noted that, while the guide covers 43 envelope the arcuate guides 38 on the outer surfaces of the axially-extending metal rails 16, they also provide sufficient clearance for the insertion of the pair of tabs 32 to be swiveled within the arcuate guides 38.

Once the inner surfaces 37 of engagement notches 36 contact the guide ends 42, the cross-bar 18 is fully installed between the trench sidewalls 12, with the engagement notches 36 being wrapped around the guide ends 42 and the engagement portions 39 being engaged with a portion of the corresponding trench sidewall 12.

The cross-bar 18 can then similarly be removed from the trench drain by swiveling the cross-bar 18 upwards, along an arcuate path reverse to that of the insertion, such that the pair of tabs 32 slide within the arcuate guides 38 and eventually exit the arcuate guides 38 at the horizontal surfaces 40 of the axially-extending metal rails 16.

Figure 6:
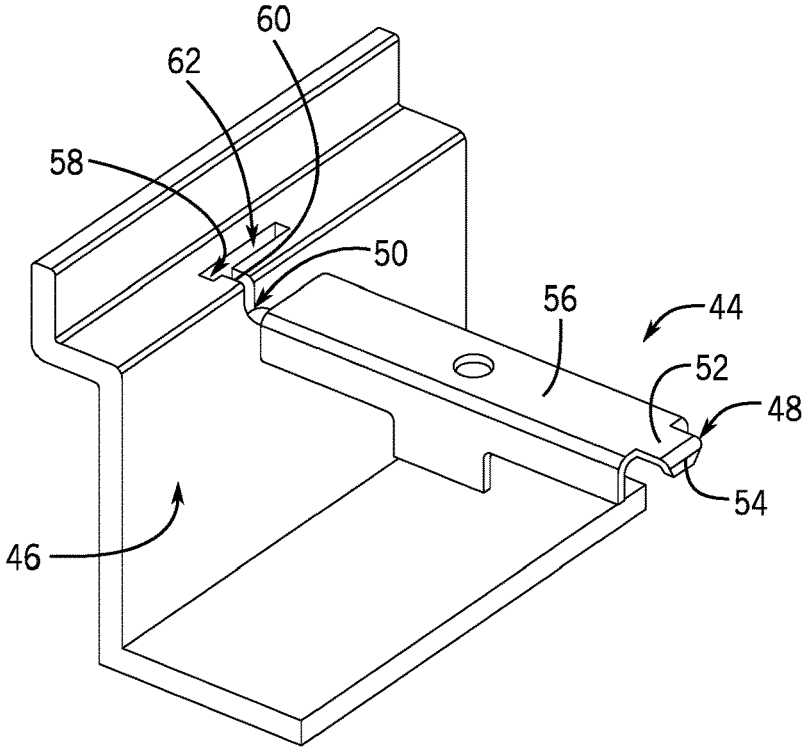
FIG. 6 is a top perspective partial view of an alternative trench drain assembly design in which the trench drain itself is completely polymeric, shown with an alternative cross-bar engaging an alternative arcuate guide.

FIG. 6 illustrates an alternative cross-bar 44 installed onto an alternative trench sidewall 46 in which the trench drain segment is entirely polymeric, not having metal rails at the top of the sidewalls 46. In FIG. 6, the cross-bar 44 includes a pair of tabs 48, one of which is shown engaging an arcuate guide 50, which is cut out from the trench sidewall 46. The trench sidewall 46 should be understood to be one of a pair of trench sidewalls, which are connected by a bottom wall (not shown), forming a trench drain generally similar to the trench drain discussed above. As such, the opposing sidewall (not shown) similarly includes a corresponding arcuate guide, mirroring the arcuate guide 50, which is configured to engage the corresponding tab 48.

As noted above, the trench sidewall 46 does not include an axially-extending metal rail, and is instead made completely of a polymeric material. Due to the lower strength of the polymeric material, a thickness of the portion of the trench sidewall 46 engaging the cross-bar 44 must be larger than the portion of the trench sidewall 12 that engages the cross-bar 18. As such, the pair of tabs 48 of the cross-bar 44 are shaped differently, being laterally longer and curved, to accommodate this larger thickness and to increase the contact area between the cross-bar 44 and the sidewall 46 to distribute the stress over the polymeric material thickness.

The pair of tabs 48 of the cross-bar 44 comprise a first engagement portion 52 and a second engagement portion 54. The first engagement portion 52 extends away from a bridging surface 56 of the cross-bar 44, generally away from the bridging surface 56, in a direction that is coplanar to a plane defined by the bridging surface 56. The second engagement portion 54 then extends substantially perpendicularly to the first engagement portion 52, curving downward.

To accommodate the second engagement portion 54, the arcuate guide 50 includes a clearance slot 58 recessed into and extending along a radially inward facing surface 60 of the arcuate guide 50. The arcuate guide 50 also includes a molding slot 62, which is provided solely for molding purposes so that the tooling members can separate from one another after the trench drain has been injected.

Despite these structural differences from the initial described embodiment, installing the cross-bar 44 between the pair of trench sidewalls 46 is substantially identical to installing the cross-bar 18 between the trench sidewalls 12, as described above. The cross-bar 44 is simply swiveled downwardly into place, with the arcuate guides 50 guiding its trajectory.

Figure 7:
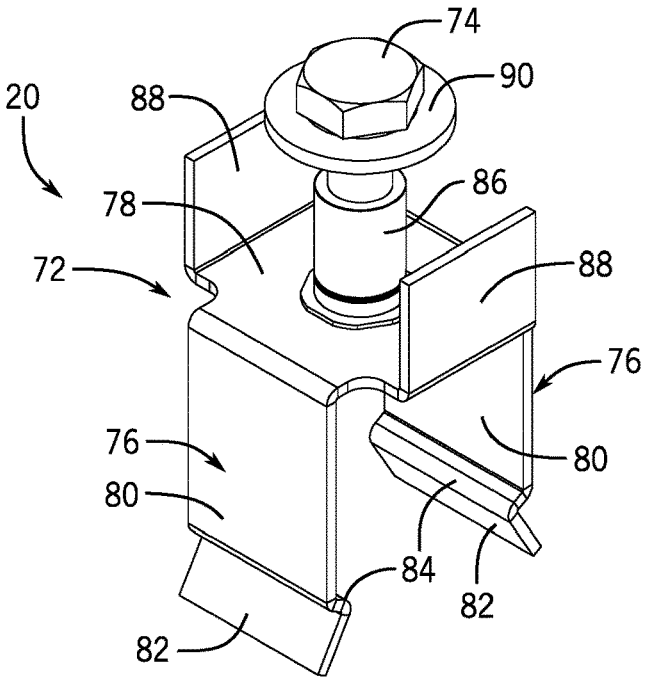
FIG. 7 is a top perspective view of a grate clip assembly of the trench drain of FIG. 1 apart from the rest of the assembly including the cross-bar and the grate to which the grate clip assembly is ultimately attached.
Figure 8:
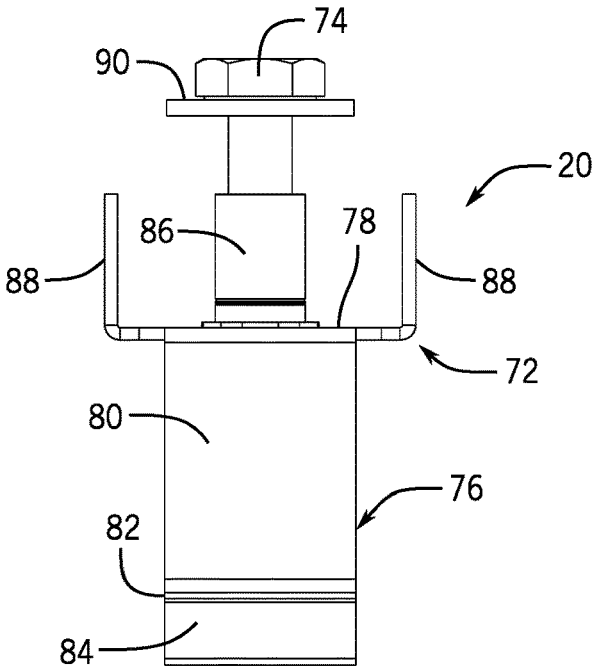
FIG. 8 is a front elevational view of the grate clip assembly of FIG. 7.

Referring now to FIGS. 7 and 8, the grate clip assembly 20 includes a grate clip 72 and a fastener 74. The grate clip 72 includes a pair of deformable catch arms 76 connected by a bridging section 78. The pair of deformable catch arms 76 can be made of a polymeric material, a metallic material, a plastic material, of any other suitable material that is elastically deformable. Each of the pair of deformable catch arms 76 includes an arm portion 80, a catch lip 82, and an opening portion 84. The arm portions 80 extend from opposing edges of the bridging section 78 in a direction substantially perpendicular to a plane defined by the bridging section 78. The arm portions 80 additionally extend between the bridging section 78 and the catch lip 82. The catch lips 82 extend away from the bridging section 78 and slightly toward each other, such that inner edges of the catch lips 82 are closer together than inner surfaces of the arm portions 80. The opening portions 84 extend both away from the bridging section 78 and outwardly from the inner edges of the catch lips 82, such that the opening portions 84 angle away from each other.

The bridging section 78 includes a fastener-receiving element 86 and a pair of support arms 88. The fastener-receiving element 86 is disposed centrally on the bridging section 78 and defines a generally cylindrical shape extending perpendicularly to the plane defined by the bridging section 78 in a direction opposite the pair of deformable catch arms 76. The fastener-receiving element 86 further includes a fastener-receiving aperture extending axially through the center of the fastener-receiving element 86. In some instances, the fastener-receiving aperture can be a threaded aperture, which can be configured to engage threads of the fastener 74. In some other instances, the fastener-receiving aperture can engage the fastener 74 in other ways. The support arms 88 extend from opposing edges of the bridging section 78 in a direction substantially perpendicular to the plane defined by the bridging section 78.

The fastener 74 in the illustrated embodiment is a hex-head bolt, which further includes a washer 90. It is contemplated that in other embodiments, the fastener 74 could be a variety of other fasteners, such as, for example, a square-head bolt, a hex-socket bolt, or any other suitable fastener. Additionally, the fastener 74 in the illustrated embodiment is a threaded fastener. In other embodiments, it is contemplated that the fastener 74 could be a non-threaded fastener. Further, the washer 90 illustrated is a flat washer. In other embodiments, the washer 90 could alternatively be a lock-washer, a toothed washer, or any other suitable washer type.

Now that the structure of the grate clip assembly 20 has been described above, a method for installing the grate 17 and the grate clip assembly 20 onto the trench drain to form the trench drain assembly 10 and the cross-bar 18, as described above, will be described below. It will again be understood that the method described below is provided as an example and is in no way meant to be limiting. Additionally, although the following description will refer to attaching the grate clip assembly 20 to the cross-bar 18 (with the grate 17 already being attached to the grate clip assembly 20 or multiple grate clip assemblies), it will be understood that a similar process can be used to attach the grate clip assembly 20 to the cross-bar 44.

Referring now to FIG. 9, after the cross-bar 18 has been installed between the trench walls 12 of the trench drain, as described above, the grate clip 72 can be installed onto the cross-bar 18 by sliding the deformable catch arms 76 onto the center of the cross-bar 18, as illustrated in FIG. 9 When sliding the deformable catch arms 76 onto the cross-bar 18, the opening portions 84 contact edges of the bridging section 26, which push the opening portions 84, and therefore the deformable catch arms 76, apart. This allows for the cross-bar 18 to slide between the deformable catch arms 76.

As the cross-bar 18 slides between the deformable catch arms 76, lower edges of the sidewall extensions 28 eventually pass the catch lips 82 of the grate clip 72. At this point, the deformable catch arms 76, being elastically deformable, return to or snap back to their non-deformed original shape. Said differently, once the lower edges of the sidewall extensions 28 pass the catch lips 82 of the grate clip 72, the deformable catch arms 76 snap around the cross-bar 18, essentially locking the grate clip 72 in engagement with the cross-bar 18.

In most instances, the grate 17 will be pre-attached to the grate clip assembly 20 (or assemblies, meaning that the grate 17 will be in place. However, it is also contemplated that the grate 17 might be attached after the grate clip 72 has been installed in place. In either event, the manner in which the grate 17 is attached to the grate clip 72 is now described. The grate 17 is placed over the grate clip assembly 20, such that the grate aperture 19 is aligned with the fastener-receiving element 86. With the grate aperture 19 aligned with the fastener-receiving element 86, the fastener 74 can be inserted through the grate aperture 19, and the fastener 74 can be threaded into the fastener-receiving element 86. As the fastener 74 is threaded into the fastener-receiving element 86, the washer 90 comes into contact with the grate aperture recess 21. The washer 90 then compresses or contacts the grate 17, which is thereby secured between the washer 90 and the grate clip 72, with the grate aperture recess 21 being compressed by the washer 90 and the grate aperture protrusion 23 being compressed by the upper surface of the bridging section 78.

Additionally, when the grate 17 is engaged with the grate clip 72, the support arms 88 are disposed between adjacent grates (not shown) to prevent the grate 17 from turning relative to the grate clip 72.

Figure 10:
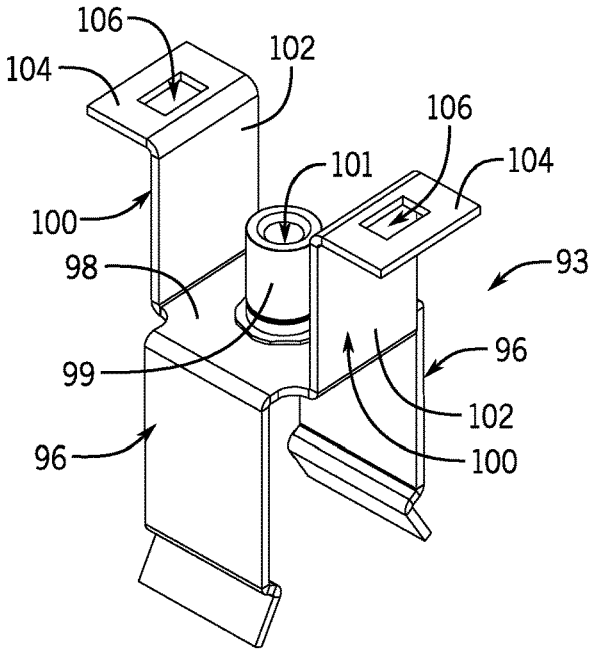
FIG. 10 is a top perspective view of an alternative grate clip assembly for use with the trench drain of FIG. 1 along with a different style of grate.

Referring now to FIG. 10, an alternative grate clip assembly 92 is illustrated for use with an alternative grate 94 as is subsequently depicted in FIG. 11. The grate clip assembly 92 similarly includes a grate clip 93 and a fastener 95. The grate clip 93 similarly includes a pair of deformable catch arms 96 connected by a bridging section 98. However the pair of deformable catch arms 96 of the grate clip 93 are slightly longer than the deformable catch arms 76 of the grate clip 72.

Additionally, the bridging section 98 similarly includes a fastener-receiving element 99 and support arms 100. The fastener-receiving element 99 again includes a fastener-receiving aperture 101, which can be threaded. The support arms 100 of the bridging section 98, however, extend farther than support arms 88 of the grate clip assembly 20. Further, each of the support arms 100 of the bridging section 98 includes a vertical portion 102 and a horizontal support portion 104. The vertical portions 102 extend vertically away from the bridging section 98. The horizontal support portions 104 extend horizontally away from a top end of the vertical portions 102. The horizontal support portions 104 further extend away from each other and each include a grate engagement aperture 106. As can be seen in FIG. 11, the fastener 95 of the grate clip assembly 92 is a Phillips raised countersunk head type bolt. Again, it is contemplated that the fastener 95 may alternatively be any other fastener deemed suitable to achieve desired results for use with varying applications.

The grate 94 is much thinner than the grate 17, although it similarly includes a grate aperture 108. The grate aperture 108, however, does not include a grate aperture recess, but rather includes a slightly rounded edge around the grate aperture 108, configured to receive the fastener 95. The grate 94 additionally includes clip engagement tabs 109, which are bent downwards and configured to engage the grate engagement apertures 106 of the grate clip 93, as will be described below.

Now that the key differences between the grate clip assembly 92 and the grate clip assembly 20 have been described above, a method of installing the grate 94 and the grate clip assembly 92 onto the trench drain will be described below. Again, it will be understood that the following description is given as an example and is in no way meant to be limiting.

The grate 94 is be placed over the grate clip assembly 92, such that the grate aperture 108 is aligned with the fastener-receiving element 99. With the grate aperture 108 aligned with the fastener-receiving element 99, the fastener 95 can be inserted through the grate aperture 108 and threaded into the fastener-receiving element 99. As the fastener 95 is threaded into the fastener-receiving element 99, the head of the fastener contacts the grate 94 and pulls the grate 94 into contact with the horizontal support portions 104 of the support arms 100. As the grate 94 contacts the horizontal support portions 104, the grate 94 is compressed between the fastener 95 and the horizontal support portions 104 of the grate clip 93. Additionally, as the grate 94 is pulled into contact with the horizontal support portions 104, the clip engagement tabs 109 become disposed within the grate engagement apertures 106, which prevents the grate 94 from rotating relative to the grate clip 93.

Figure 11:
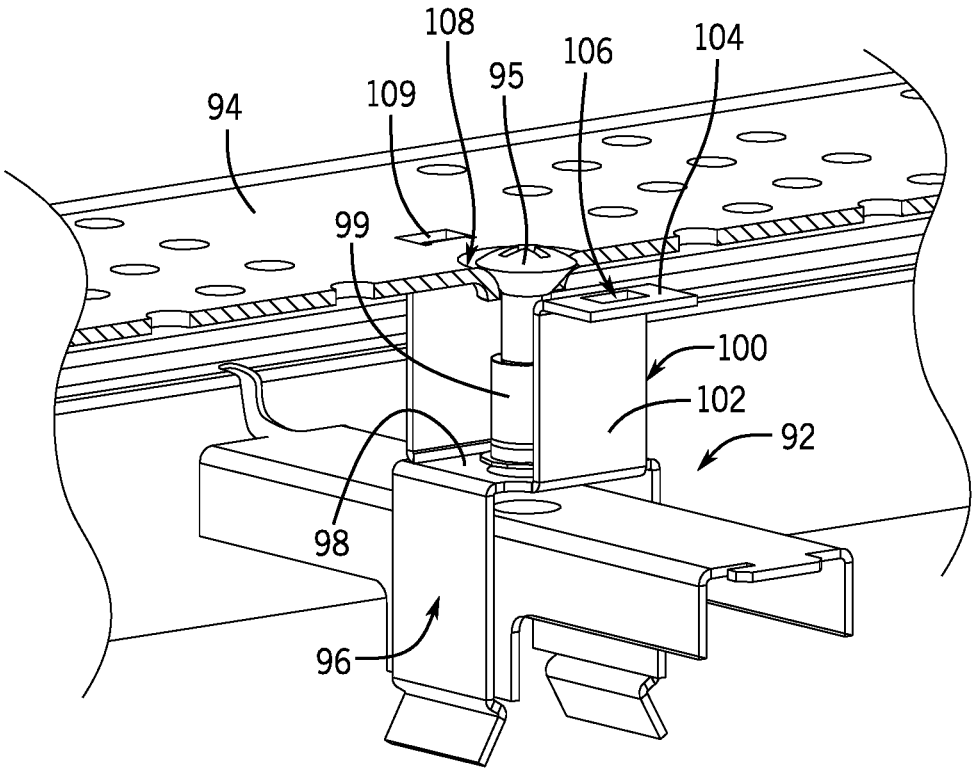
FIG. 11 is a partial cross-sectional view of the grate clip assembly of FIG. 10 installed on the trench drain of FIG. 1, shown engaged with an alternative grate.

With the grate 94 assembled to the grate clip assembly 92, the deformable catch arms 96 may be depressed onto either of the cross-bars 18, 44, as described above, with reference to the grate clip 72 as is generically depicted in FIG. 11.

It will be understood that either of the grate clip assemblies 20, 92 can be installed onto either of the cross-bars 18, 44 described above, or can alternatively be installed onto varying other types of cross-bars having compatible geometries. Furthermore, there may be situations where either of the cross-bars 18, 44 may be installed without either the grate clip assemblies 20, 92, or, in some cases, may be installed with other grate clip assemblies having compatible geometries.

It should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A trench drain assembly comprising:

a pair of trench sidewalls;

a cross-bar extending between the pair of trench sidewalls;

a grate spanning between the pair of trench sidewalls and extending along an axial direction of the trench drain assembly;

a grate clip assembly having a grate clip and a fastener, the grate clip having a pair of deformable catch arms connected by a bridging section, the fastener being coupled to the grate clip and securing the grate to the grate clip; and wherein the pair of deformable catch arms are configured to reversibly engage the cross-bar.

2. The trench drain assembly of claim 1, wherein the grate is secured between the fastener and an upper surface of the bridging section of the grate clip.

3. The trench drain assembly of claim 1, wherein the grate clip further includes upper engagement surfaces disposed upwardly from the bridging section of the grate clip and, when the grate is secured to the grate clip, the grate is secured between the fastener and the upper engagement surfaces of the grate clip.

4. The trench drain assembly of claim 1, wherein each trench sidewall of the pair of trench sidewalls includes an arcuate guide disposed proximate an upper end of the corresponding trench sidewall, the cross-bar includes a pair of tabs extending from opposite ends of the cross-bar, and each tab of the pair of tabs is configured to engage one of the arcuate guides of the pair of trench sidewalls.

5. The trench drain assembly of claim 4, wherein each tab of the pair of tabs includes an extension extending parallel to an edge of the corresponding end of the cross-bar.

6. The trench drain assembly of claim 1, wherein the pair of trench sidewalls each include an arcuate guide disposed proximate an upper edge of the corresponding trench sidewall, and the cross-bar includes a pair of tabs extending from opposite ends of the cross-bar.

7. The trench drain assembly of claim 6, wherein each of the pair of tabs is configured to engage one of the arcuate guides of the pair of trench sidewalls.

8. The trench drain assembly of claim 7, wherein the arcuate guides of the pair of trench sidewalls extend through an upper surface of the corresponding trench sidewall.

9. The trench drain assembly of claim 8, wherein the arcuate guides allow for the pair of tabs of the cross-bar to be inserted into corresponding arcuate guides and swiveled into engagement with the corresponding arcuate guides.

10. A trench drain assembly comprising:

a pair of trench sidewalls each including an arcuate guide disposed proximate an upper edge of the corresponding trench sidewall; and a cross-bar extending between the pair of trench sidewalls and including a pair of tabs extending from opposite ends of the cross-bar;

wherein each of the pair of tabs is configured to engage one of the arcuate guides of the pair of trench sidewalls.

11. The trench drain assembly of claim 10, wherein the arcuate guides of the pair of trench sidewalls extend through an upper surface of the corresponding trench sidewall.

12. The trench drain assembly of claim 11, wherein the arcuate guides allow for the pair of tabs of the cross-bar to be inserted into corresponding arcuate guides and swiveled into engagement with the corresponding arcuate guides.

13. The trench drain assembly of claim 10, wherein the cross-bar includes a pair of cross-bar sidewalls connected by a bridging surface, and wherein the pair of tabs extend from the bridging surface.

14. The trench drain assembly of claim 10, further comprising:

a grate spanning between the pair of trench sidewalls and extending along an axial direction of the trench drain assembly; and a grate clip assembly having a grate clip and a fastener, the grate clip having a pair of deformable catch arms connected by a bridging section, the fastener being coupled to the grate clip and securing the grate to the grate clip;

wherein the pair of deformable catch arms are configured to reversibly engage the cross-bar.

15. The trench drain assembly of claim 14, wherein the grate is compressed between the fastener and an upper surface of the bridging section of the grate clip.

16. The trench drain assembly of claim 14, wherein the grate clip further includes upper engagement surfaces disposed upwardly from the bridging section of the grate clip and, when the grate is secured to the grate clip, the grate is secured between the fastener and the upper engagement surfaces of the grate clip.

* * * * *